United States Patent [19]

Horstman et al.

[11] 4,042,009

[45] Aug. 16, 1977

[54] STRIP FOR COVERING AN ELONGATED MOLD CAVITY IN A CONTINUOUS CASTING MACHINE

[75] Inventors: Wilhelm Horstman, Osnabruck; Werner Meyer, Hannover, both of Germany; Fred F. Polizzano, deceased, late of Allendale, N.J., by Anita Polizzano, executrix

[73] Assignee: Kabel-und Metallwerke Gutehoffnungshutte AG., Hannover, Germany

[21] Appl. No.: 602,763

[22] Filed: Aug. 7, 1975

[30] Foreign Application Priority Data

Aug. 31, 1974 Germany ..... 2441795

[51] Int. Cl.[2] ..... B22D 11/06

[52] U.S. Cl. ..... 164/278

[58] Field of Search ..... 228/144, 151; 164/278, 164/87; 425/433

[56] References Cited

U.S. PATENT DOCUMENTS

| | | | |
|---|---|---|---|
| 359,348 | 3/1887 | Daniels | 164/278 X |
| 1,805,283 | 5/1931 | Hammerstrom | 228/151 |
| 1,816,534 | 7/1931 | Hume | 228/151 |
| 3,474,853 | 10/1969 | Hazelett et al. | 164/278 |

OTHER PUBLICATIONS

Metal Progress Databook, Second Edition by A. G. Gray (of ASM) copyright 1970.

*Primary Examiner*—Richard B. Lazarus
*Attorney, Agent, or Firm*—Ralf H. Siegemund

[57] ABSTRACT

A casting machine has a revolving drum, having groove looping around the periphery and being partially covered by a portion of an endless strip to establish therewith a mold cavity for continuous casting. The strip is made of a copper alloy with iron or chromium and/or zirconium added in small amounts to obtain a heat resistant, age hardening alloy. The strip ends have been butt welded by an electron beam and from both sides to obtain an oblique welding seam.

10 Claims, 2 Drawing Figures

FIG. 1
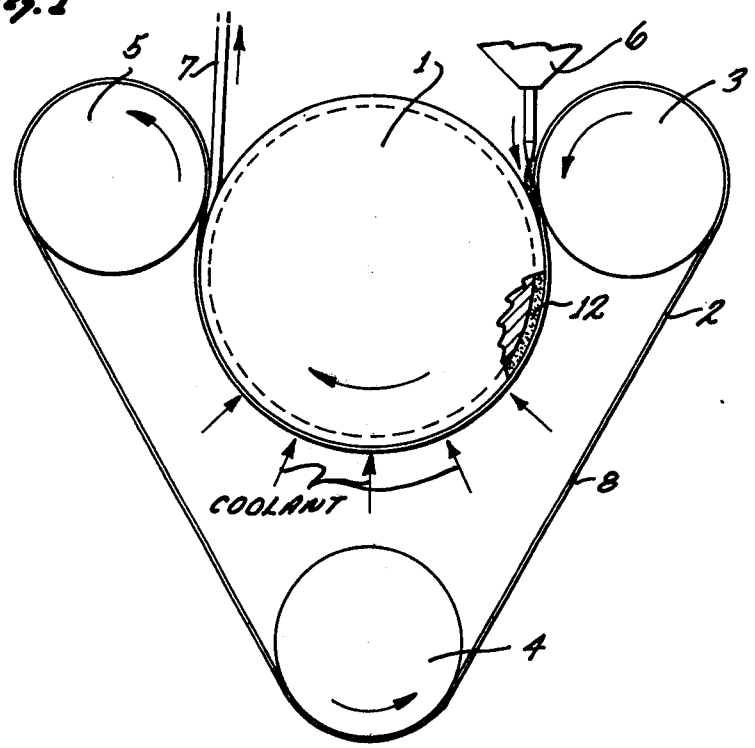
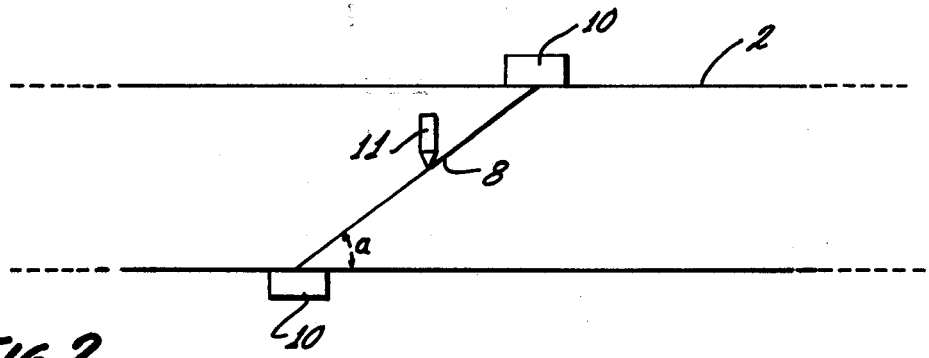
FIG. 2

STRIP FOR COVERING AN ELONGATED MOLD CAVITY IN A CONTINUOUS CASTING MACHINE

BACKGROUND OF THE INVENTION

The present invention relates to continuous casting of metal by means of a revolving drum having a groove which loops around the periphery of the drum and into which molten material, e.g. steel. aluminum or copper is poured to solidify therein and to be withdrawn as a casting or elongated ingot in a continuous casting process. More particularly the invention relates to a strip for such a machine which covers the portion of the groove filled with molten material, to define therewith the mold cavity.

Casting machines of the type outlined above are already known and the cover strip employed here is a metal strip which is longer than the periphery of the drum, but runs in engagement therewith over a portion of the drum's periphery. The location where the strip begins to engage the drum is an entrance to the resulting curved, duct-like mold cavity into which molten metal is poured. The casting emerges from that cavity where the strip disengages from the drum. Both, the interior of the drum and the outwardly facing surface of the strip where covering the drum, are subjected to cooling by means of liquid, e.g. water.

In accordance with the German printed patent application No. 1,458,198 such a casting and covering strip is to be made of steel. It was found, however, that a steel strip is not completely satisfactory with regards to strength at high temperature. Also, cooling the solidifying casting through such strip is sufficient only as long as the strip is very extensively cooled and by means of very large quantities of coolant. The equipment necessary here increases cost of such a facility.

DESCRIPTION OF THE INVENTION

It is an object of the present invention to improve casting equipment of the type to which the invention refers.

It is a specific object of the present invention to provide for a new and improved cover strip for casting drums in such equipment and which permits rapid outflow of heat and great strength at high temperatures.

In accordance with the preferred embodiments of the invention, it is suggested to construct the casting strip from a strip made from a heat resisting, age hardened copper alloy and having its ends joined by means of fusion welding to form an endless belt. The seam has preferably an acute angle to the direction of application of pulling force during operation. Such a strip permits heat removal from the molten material at a very high rate and under controlled conditions which is beneficial for the internal texture of the casting. The strip has strength comparable with the strength of steel for similar temperatures, however, heat is conducted through the novel strip at a significantly higher rate than through a steel strip, so that the effective thermal load on the strip is lower accordingly, Also, it was found that the casting speed can be increased, if one proceeds in accordance with the invention.

The strip is preferably made of copper with zirconium, and/or chromium added. The zirconium content should be between 0.05 to 0.2% and the chromium content should be between 0.4 to 0.6%. Alternatively one could add 0.5 to 3%, preferably 2 to 3% iron with or without 0.05 to 0.2%, preferably 0.15% zirconium (all percentages by weight).

The strip ends are preferably cut to have oblique edges at an angle from 30° to 45° which are juxtaposed and buttwelded by fusion welding; preferably electron beam welding is employed here and applied preferably from both sides to obtain a narrow seam. Shims should be used at the ends of the joints, adjacent the pointed strip ends for both, control of the welding thereat as well as for starting the seam and igniting any arc.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a schematic view of casting equipment which incorporates the principles of the invention; and FIG. 2 is a view of a portion of a casting strip used in the equipment of FIG. 1.

Proceeding now to the detailed description of the invention, FIG. 1 shows a revolving casting drum 1 having e.g. a groove for defining a mold cavity 12. The drum 1 is journalled in a frame (not shown) and driven continuously. A flexible casting strip 2 is provided for engagement with the drum over about 180° thereby covering the lower half of the mold space or cavity 12.

The strip 2 is held against drum 1 by means of idler pulleys or rolls 3 and 5, and a third idler 4 provides for the return path because strip 2 is of endless configuration, and longer than the perimeter of the drum. Strip 2 is, therefore, guided and held by the three idler rolls 3, 4 and 5 and is driven through frictional engagement with driven drum 1 adjacent to and along both sides of the groove as covered. Therefore, the strip or belt 2 preferably covers progressing portions of the groove and uncovers portions at the same rate.

The purpose of the equipment, for example, is to cast elongated stock on a continuous basis. Thus, a casting ladle, funnel, gate 6 or the like causes molten material such as steel, copper or aluminum to be poured into casting and mold space 12, right where being covered by casting strip 2.

The molten material is carried along by the drum and held by cover strip 2 in the cavity 12. The material solidifies and is taken as a solid casting 7 from the cavity 12 where the cover strip 2 recedes from drum 1. A portion of the heat content of the molten material is conducted into the internally cooled drum 1, and another portion of the heat is conducted through strip 2. Cooling water may be applied to the outside surface of strip 2 where facing away from the drum.

The casting and cover strip 2 is made of age hardened copper alloy and has configuration of an endless belt in that the two ends of such a strip are joined along an oblique, joint line and welding seam 8 made by means of fusion welding. That seam has an angle from 30° to 45° to the longitudinal direction of extension of endless belt-strip 2 to enhance pulling strength in that direction.

In accordance with the preferred embodiment of the present invention, the casting and cover strip 2 is made of an age hardened copper alloy in which 0.05 to 0.2% zirconium and/or 0.4 to 0.6% chrominum has been alloyed with copper. Alternatively, 0.5 to 3%, preferably 2 to 3% iron and about 0.05 to 0.2%, preferably 0.15% zirconium are alloyed with copper, possibly under spurious addition of zinc, tin or aluminum.

Either material provides for sufficiently high thermal conductivity and thermal stability. Specifically, these copper alloys have a heat conductivity in the order of 70 90 IACS, after age hardening. The strength of these alloys is in the order of 400 to 500 Newton/mm$^2$ and these values reduce very little with high temperatures as they arise upon casting material of the type mentioned above. Since, as stated, the fusion welding seam has an angle of 30° to 45° to the length axis of the strip, the overall strength thereof is very little reduced by the welding seam as such.

Turning now to FIG. 2, it shall be explained how the casting and cover strip is made and constructed as an endless belt. The ends of such a strip of suitable length are cut to have an angle $\alpha$ between 30° to 45° to the longitudinal direction of the strip. The oblique edges are placed next to each other in parallel, abutting relation for butt welding.

Shim plates 10 are placed firmly next to the strip ends, near the respective points 9, but the shim plates extend respectively across the ends of the joint line. These shims are preferably made of the same material as the strip and have the same thickness. Thereafter, shims 10 and the strip are clamped to assume and maintain a definite position relation as needed for welding. The shims 10 provide for improved heat flow near the points 9 to avoid welding craters. Moreover, the shims 10 are provided for igniting the welding arc or to inititate the electron beam.

The welding seam 8 is provided by the electrode 11 in the general sense by means of which first one side and then the opposite side of the strip and edges are fusion welded. This method is particularly advantageous when the strip 2 is rather thick, e.g. 1 to 3 mm or even thicker. Welding from both sides is very advantageous here, particularly, because the rather high welding energy can be divided, and one readily avoids defects in the seam in that manner. The shims are additionally instrumental here to avoid faulty welding particularly adjacent the peaks 9. The shims are particularly helpful with regard to control of the heat flow in this area during welding. Of course, the shims are removed subsequently.

The strip ends are preferably welded together by means of an electron beam in vacuum. Electron welding has the advantage of producing a very narrow seam which is beneficial with regard to strength of the resulting endless strip, in longitudinal direction in particular. The welding seam is preferably treated subsequently to match the texture thereof to the texture of the strip as such. Particularly, the seam should be strengthened, for example by means of annealing, cold rolling at temperatures below the recrystallization temperature or any other known method. The same additives, such as used for alloying the particular strip, can be provided in addition to a copper wire used for welding, but that is not essential.

The resulting casting and cover strip is very well suited for fast removal of heat from the content of the mold cavity 12. Moreover, the high thermal conductivity of strip 2 permits more ready control of the cooling process, as any changes in the external coolant is rather speedily transmitted to the mold content - strip interface. The strip when made as outlined above is very strong even at high temperatures.

The invention is not limited to the embodiments described above, but all changes and modifications thereof not constituting departures from the spirit and scope of the invention are intended to be included.

We claim:

1. In a casting machine having a rotating drum with a mold cavity defining groove or the like looping around its periphery, and having means pouring molten material into the groove an endless covering part of the groove along said periphery, (i) for completing the cavity from which an elongated casting is withdrawn and (ii) being cooled from the side opposite the covered groove for cooling the molten material when in the cavity, and (iii) moving in a closed loop part of which moving without covering any part of the grooves, comprising:

the strip being made of a heat resisting, age hardened copper alloy with a dominating copper content, and having oblique ends joined by fusion welding to obtain an endless belt with a fusion welded joint which extends at an angle of from about 30° to about 45° to a direction of movement and of longitudinal extension of the belt, the belt moving with the drum for covering said part on a progressive basis.

2. The strip as in claim 1, being made of a copper zi conium alloy having 0.05 to 0.2% by weight zirconium, the remainder being copper.

3. The strip as in claim 1, being made of a copper chromium alloy having 0.4 to 0.6% by weight chromium, the remainder being copper.

4. The strip as in claim 1 being made of a copper-zirconium-chromium alloy having 0.05 to 0.2% zirconium, 0.4 to 0.6% chromium, all percentages by weight, the remainder being copper.

5. Strip as in claim 1 being made of a copper iron alloy having 0.5 to 3% by weight iron, the remainder being copper.

6. Strip as in claim 1 being made of a copper iron alloy having 2 to 3% weight iron, the remainder being copper.

7. Strip as in claim 1 being made of a copper-iron-zirconium alloy, having 0.5 to 3% iron and 0.05 to 0.2% zirconium all percentages by weight, the remainder being copper.

8. Strip as in claim 1 being made of a copper-iron-zirconium alloy having 2 to 3% iron and about 0.15% zirconium, all percentages by weight, the remainder being copper.

9. Strip as in claim 1 wherein said ends having been joined by electron welding.

10. Strip as in claim 1 wherein the joint is established by two welding seams, one on each side of the strip.

* * * * *